United States Patent [19]

Howard

[11] 4,276,929

[45] Jul. 7, 1981

[54] HEAT EXCHANGER

[75] Inventor: Thomas Howard, Lindenhurst, N.Y.

[73] Assignee: T.J.D. Industries, Ltd., Lindenhurst, N.Y.

[21] Appl. No.: 101,449

[22] Filed: Dec. 10, 1979

[51] Int. Cl.[3] ..... F28F 9/22; F24H 3/08; F24B 7/04

[52] U.S. Cl. ..... 165/145; 165/DIG. 2; 237/55

[58] Field of Search ..... 165/164, 165, 145, DIG. 2; 237/55

[56] References Cited

U.S. PATENT DOCUMENTS

| | | | |
|---|---|---|---|
| 1,814,010 | 7/1931 | Snow | 165/145 |
| 2,735,660 | 2/1956 | Craig | 165/145 |
| 2,789,554 | 4/1957 | Dupler | 237/55 |
| 3,124,197 | 3/1964 | Funk | 237/55 |
| 4,050,628 | 9/1977 | Konnerth | 237/55 |
| 4,103,735 | 8/1978 | Warner | 165/DIG. 2 |

*Primary Examiner*—Sheldon J. Richter

*Attorney, Agent, or Firm*—Stephen E. Feldman; Marvin Feldman

[57] ABSTRACT

A heat exchanger comprises an outer chamber having an inlet and outlet for passing a flow of air through the outer chamber. An inner chamber is disposed within the outer chamber and has a second inlet and a second outlet for passing a flow of gas through the inner chamber. Heat exchange tubes are arranged in the inner chamber whereby the flow of gas contacts the outer surface of the tubes. A baffle device is disposed between the inner and outer chamber for directing the flow of air from the inlet, through a first section having heat exchange tubes, into the outer chamber and back into a second section having heat exchange tubes, so that air passes through the heat exchange tubes in the first and second sections.

9 Claims, 6 Drawing Figures

HEAT EXCHANGER

BACKGROUND OF THE INVENTION

While the invention is subject to a wide range of applications, it is especially suited for use as a heat reclaimer in a heating system and will be particularly described in that connection.

Boilers and hot air furnaces which are used particularly for home heating, frequently suffer from a substantial loss of a portion of the heat which they produce. This heat generally passes out of a flue stack into the atmosphere. In the past, a number of patents have described a heat exchanger which is used in conjunction with the flue to reclaim the lost heat and use it in an efficient manner. Several prior art patents cited below disclose this general principle.

U.S. Pat. No. 3,913,663 to Gates discloses an energy conservation chamber whereby discharged heated gas from a combustion fuel heating apparatus is directed along a circuitous path through spaced inner and outer chambers prior to discharge.

U.S. Pat. No. 3,934,798 to Goldsmith discloses a heat saving apparatus for saving heat in a forced draft home heating system by directing air from a return register to the return plenum through a heat exchanger interposed in the line of the flue.

U.S. Pat. No. 3,944,136 to Huie discloses an auxiliary heating system including a heat exchanger mounted in a stack flue and a stack gas cooler in the exit portion of the heat exchanger which includes an adjustable damper.

U.S. Pat. No. 4,079,885 to Decker discloses an apparatus for utilizing the waste heat from furnace combustion whereby the heat is caused to pass over and around a heat exchanger which moves air by a blower through this exchanger into a desired space.

Each of the prior art systems mentioned above reclaims lost heat. However, due to their construction, they do not provide for the efficient and thorough removal of heat as within the present invention. In view of the ever increasing expense for energy, improved efficiency is of major economic importance.

It is an object of the present invention to provide a heat exchanger which is very efficient.

It is a further object of the present invention to provide a heat exchanger which is relatively inexpensive to manufacture.

It is a still further object of the present invention to provide a heat exchanger which is relatively easy to install.

SUMMARY OF THE INVENTION

Accordingly, there has been provided a heat exchanger comprising an outer chamber having an inlet and outlet for passing a flow of air through the outer chamber. An inner chamber is disposed within the outer chamber and has a second inlet and a second outlet for passing a flow of gas through the inner chamber. Heat exchange tubes are arranged in the inner chamber whereby the flow of gas contacts the outer surface of the tubes. A baffle device is disposed between the inner and outer chamber for directing the flow of air from the inlet, through a first section having heat exchange tubes, into the outer chamber and back into a second section having heat exchange tubes so that air passes through the heat exchange tubes in the first and second section for higher heat exchange.

For a better understanding of the present invention, together and with other and further objects thereof, reference is had to the following description, taken in connection with the accompanying drawings, while its scope will be pointed out in the appended claims.

DESCRIPTION OF THE PREFERRED EMBODIMENT

Figure 2:
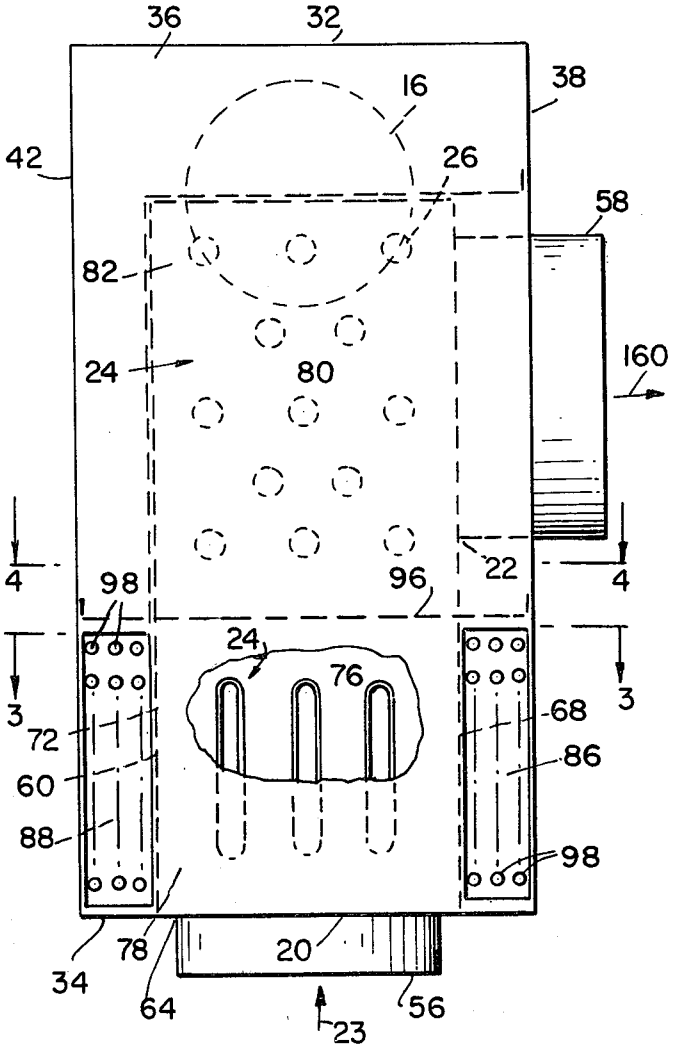
FIG. 2 is a view through 2—2 of FIG. 1.

A heat exchanger 10 comprises an outer chamber 12 having an inlet 14 and an outlet 16 for passing a flow of air 17 through the outer chamber 12. An inner chamber 18 is disposed within the outer chamber 12 and has a second inlet 20 and a second outlet 22 for passing a flow of gas 23 through the inner chamber 18. Heat exchange tubes 24 are arranged in the inner chamber 18 whereby the flow of gas contacts the outer surface 26 of the tubes 24. A baffle device 28 is disposed between the inner and outer chambers for directing the flow of air 17 from the inlet 14 through the heat exchange tubes 24 into the outer chamber 12 and back into the heat exchange tubes 24 whereby heat is exchanged between the air and gas flows 17 and 23.

Figure 1:
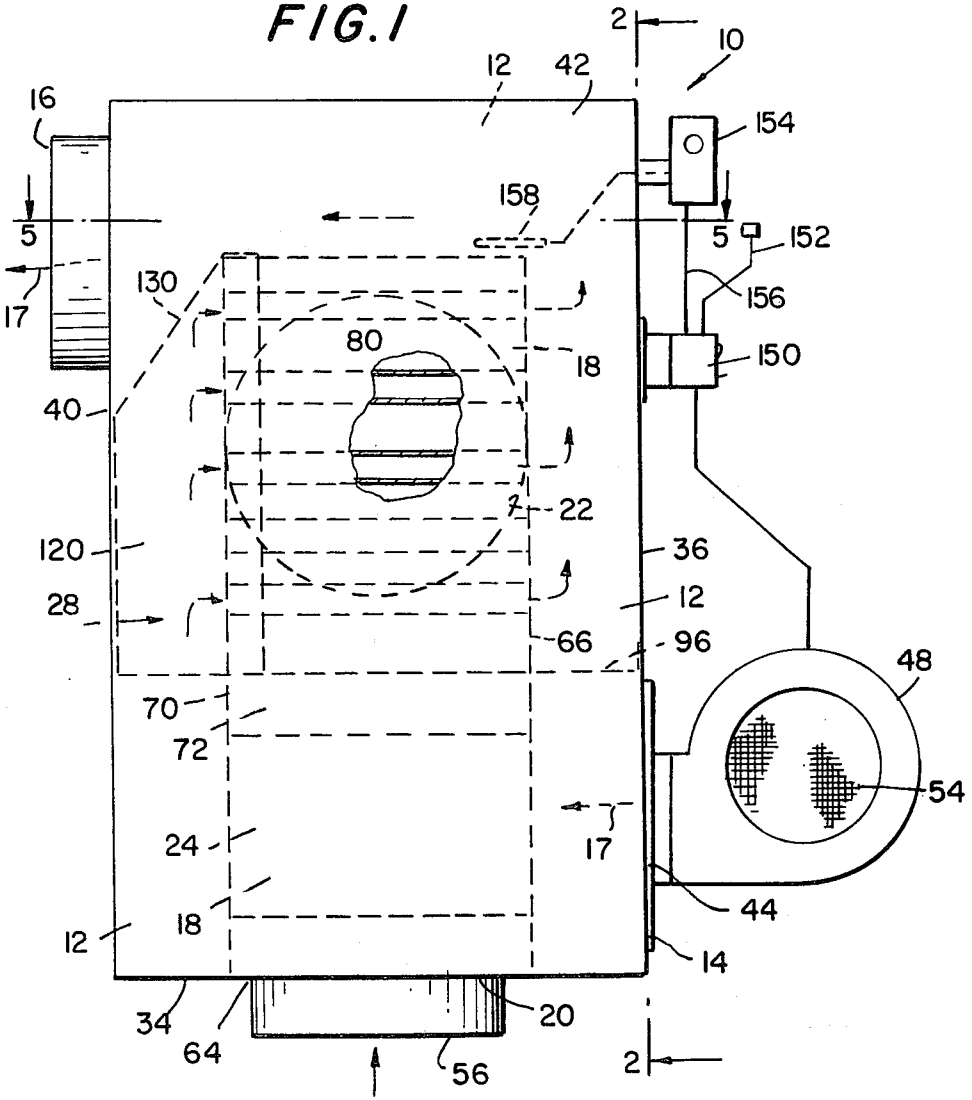
FIG. 1 is a front view of a heat exchanger in accordance with the present invention.

Referring to FIG. 1, there is illustrated a heat exchanger which extracts wasted heat from flue gas and returns the heat to a desired space. The heat exchanger 10 is formed of an outer housing 30 made out of some desirable metal such as for example, steel or aluminum. The outer housing surrounds a space called the outer chamber 12 which is formed by spaced opposed upper and lower outer ends 32 and 34. Also, four sides walls 36 through 42 are adjoined to the outer ends. The inlet 14 is located in the side wall 36 adjacent the lower outer end 34. The inlet may include two circular flanges 44 and 46. Two blowers 48 and 50 are connected to the flanges 44 and 46 respectively and are operated by a motor 52. A screened inlet 54 is provided on each blower for safety purposes as the air is pulled into the blower and sent into the inlet. The blower preferably provides between 200–500 cubic feet/minute (CFM) of air, however, it is within the scope of the invention to use any desired size blower as required. Also, through the preferred embodiment includes two inlets, it is within the scope of the invention to use only one inlet with one blower attached thereto.

The outlet 16 is preferably a circular flange disposed adjacent the upper end 32 in a side wall 40 which opposes the side wall 36. The outlet 16 is preferably connected to a space which is to be heated by any conventional means such as aluminum duct work.

Referring to FIGS. 1 and 2, there is illustrated an inlet pipe 56 which extends through the lower outer end 34 and is connected to the inlet 20 of the inner chamber 18. A second outlet pipe 58 extends through the side wall 38 and is connected to the second outlet 22. In a typical installation of the heat exchanger, the inlet pipe 56 is connected to the flue stack of a burner so that the flue gas passes through the inlet pipe into the inner chamber.

The outlet pipe 58 is attached to the other side of the flue stack so that the flue gas 23 which is exiting from the inner chamber can be directed out of the system after a substantial portion of its heat has been transferred to the flow of air 17 passing through the outer chamber 12. It is also within the scope of the present invention to reverse the inlet and outlet 56 and 58 so that the flue gas from the burner could enter into the pipe 58 and exit from the pipe 56.

Referring to FIGS. 1 and 2, there is shown an inner chamber 18 which is disposed within the outer chamber 12. The inner chamber has a continuous wall 60 which is disposed within the outer chamber and has spaced opposed upper and lower inner ends 62 and 64 which are opposite the upper and lower outer ends 32 and 34 respectively. The upper inner end 62 is spaced from the upper outer end 32 to provide a flow path as will be further described. The lower inner end 64 may be adjoined to or actually be a portion of the lower outer end 34. The continuous wall 60 includes four inner wall 66 through 68. The inner walls, preferably have a square cross-section as see in FIGS. 3 and 4. The area of the square cross section minus the area of tubes 24 is approximately equal or greater than the area of the inlet 56. It is within the scope of the present invention to form the continuous wall in any desired configuration, such as for example, a rectangle or a circle. The inner walls may be constructed of any desired material such as a heavy black iron which acts to store and conduct the heat.

The second inlet 20 has a inlet pipe 56 adjoined thereto and the pipe extends through the lower outer end 34 as explained above. The second outlet 22 has an outlet pipe 58 attached thereto and the outlet pipe extends through the side wall 38 as previously mentioned.

Heat exchange tubes are arranged in the inner chamber 18 whereby the flow of gas which enters the inlet 14 can pass through the inner chamber and contact the outer surface of the tubes. The heat exchange tubes 24 includes a first plurality of tubes 76 which are disposed in a first section 78 of the inner chamber closest to the inlet. The tubes 76 are connected between opposing inner walls 66 and 70 (which are disposed opposite the inlet and outlet 14 and 16 of the outer chamber) and are attached to the inner walls in the air-tight manner by any conventional technique.

A second plurality of tubes 80 are disposed in a second section 82 of the inner chamber above the first section 78. These tubes are connected between opposing inner walls 66 and 70 as with the first plurality of tubes 76 described above. The tubes 80 may be arranged within the second section 82 in any desired configuration and in any number. These tubes are preferably circular copper tubes which are connected to the side walls in an air-tight manner.

Figure 3:
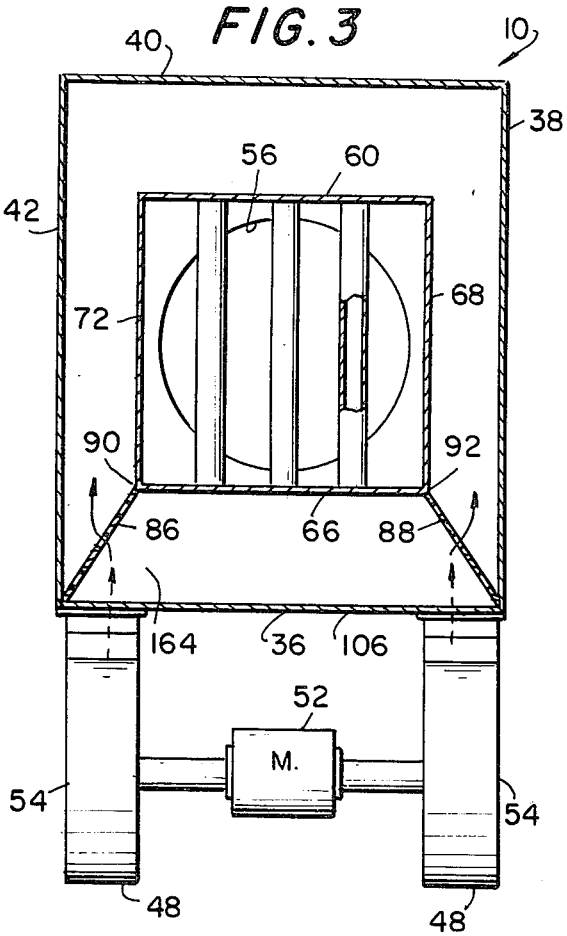
FIG. 3 is a view through 3—3 of FIG. 2.
Figure 4:
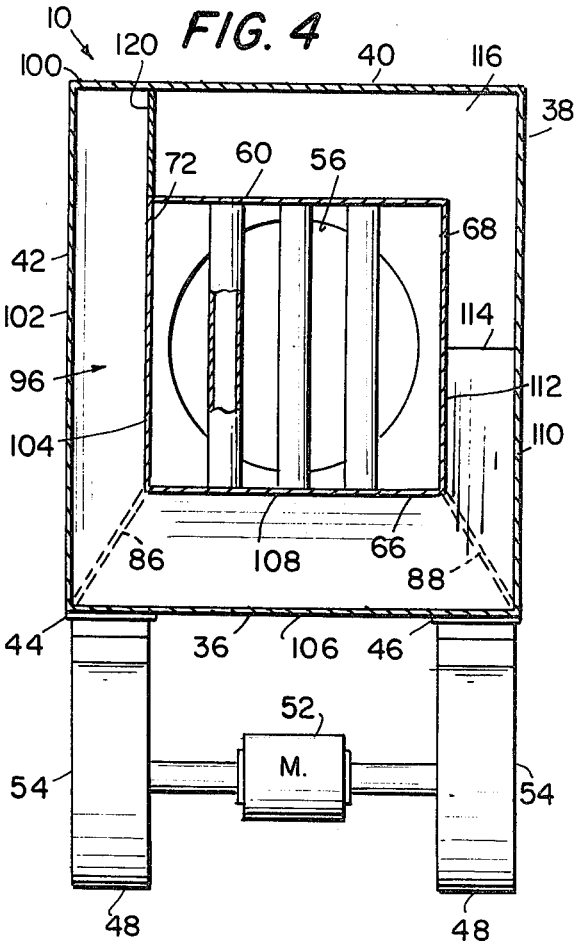
FIG. 4 is a view through 4—4 of FIG. 2.

A baffle device generally indicated at 28 is disposed between the inner and outer chambers for directing the flow of air from inlet 14 along a circuitous path through the inner and outer chambers. In general, the baffle device forces the air to contact surfaces heated by the gas 23 throughout the heat exchanger and thereby efficiently provides for a high heat transfer in a relatively small device. The baffle device includes two vertical perforation plates 86 and 88 (as best seen in FIGS. 2 and 3) which extend from the edges 90 and 92 of the inner wall 66, at the junction with inner walls 72 and 68 respectively. The plates 86 and 88 are also joined to the first side wall 36 preferably at the juncture with side walls 42 and 38. In addition, the perforation plates are adjoined to a horizontal plate 96 (as best seen in FIG. 4), as well as to the lower outer end 34. The vertical perforation plates include a large number of small orifices 98 which are preferably circular and arranged in any desired pattern across the perforation plates. In addition, the orifices may be made with any configuration as desired. The perforation plates operate in conjunction with the horizontal plate 96 to permit some portion of a flow of air from inlet 14 to bypass the plurality of tubes 76 and pass through the outer chamber. In the preferred embodiment, 50% is bypassed but it is within the scope of the present invention to use any desired percentage. Thus, it can be appreciated that the number, size and configuration of the orifices 98 determines the percentage of air which initially bypasses the inner chamber.

Figure 5:
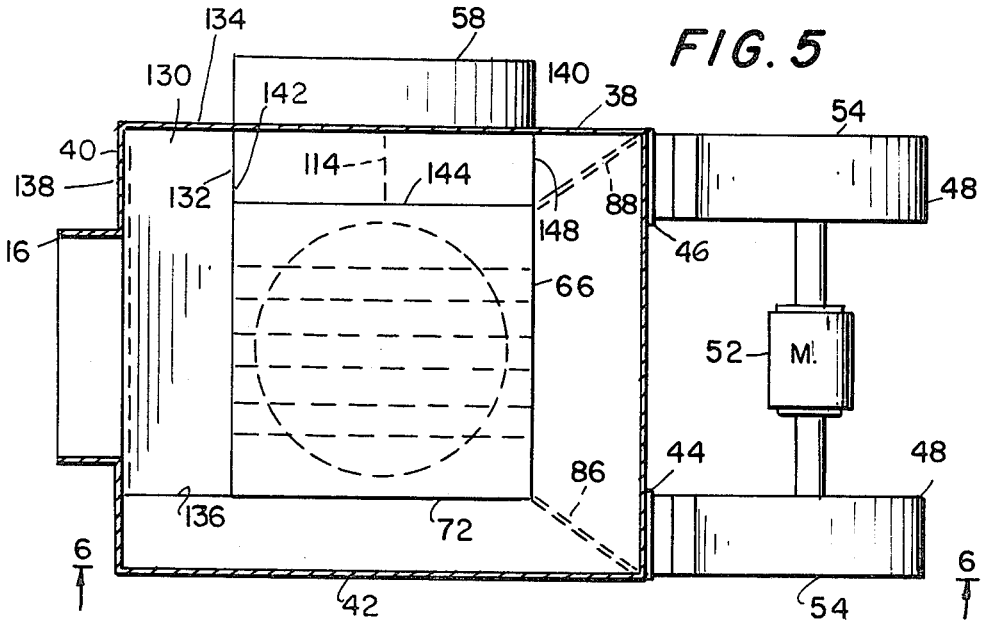
FIG. 5 is a view through 5—5 of FIG. 1.

The baffle device 28 also includes a horizontal plate 96 which as previously mentioned is best seen in FIG. 4. The horizontal plate is joined between the walls of the inner and outer chambers at the juncture between the first and second sections 78 and 82. The horizontal plate may be formed of a single piece of material which is securely fastened between the walls which form the inner end and outer chambers. The horizontal plate has one edge 100 attached to the wall 40. The plate has edges 102 and 104 which are attached to walls 42 and 72 respectively. Further, the edges 106 and 108 are secured to the walls 36 and 66 respectively. The edges 110 and 112 are secured to the walls 38 and 68 respectively. The edge 114 of the horizontal plate preferably terminates at the approximate midpoint of the outlet pipe 58 as can be seen in FIG. 5. The horizontal plate 96 extends only partially around the inner chamber to form an L-shaped opening 116. The opening 116 directs a portion of the flow of air across the outlet pipe 58 as will be further described.

Figure 6:
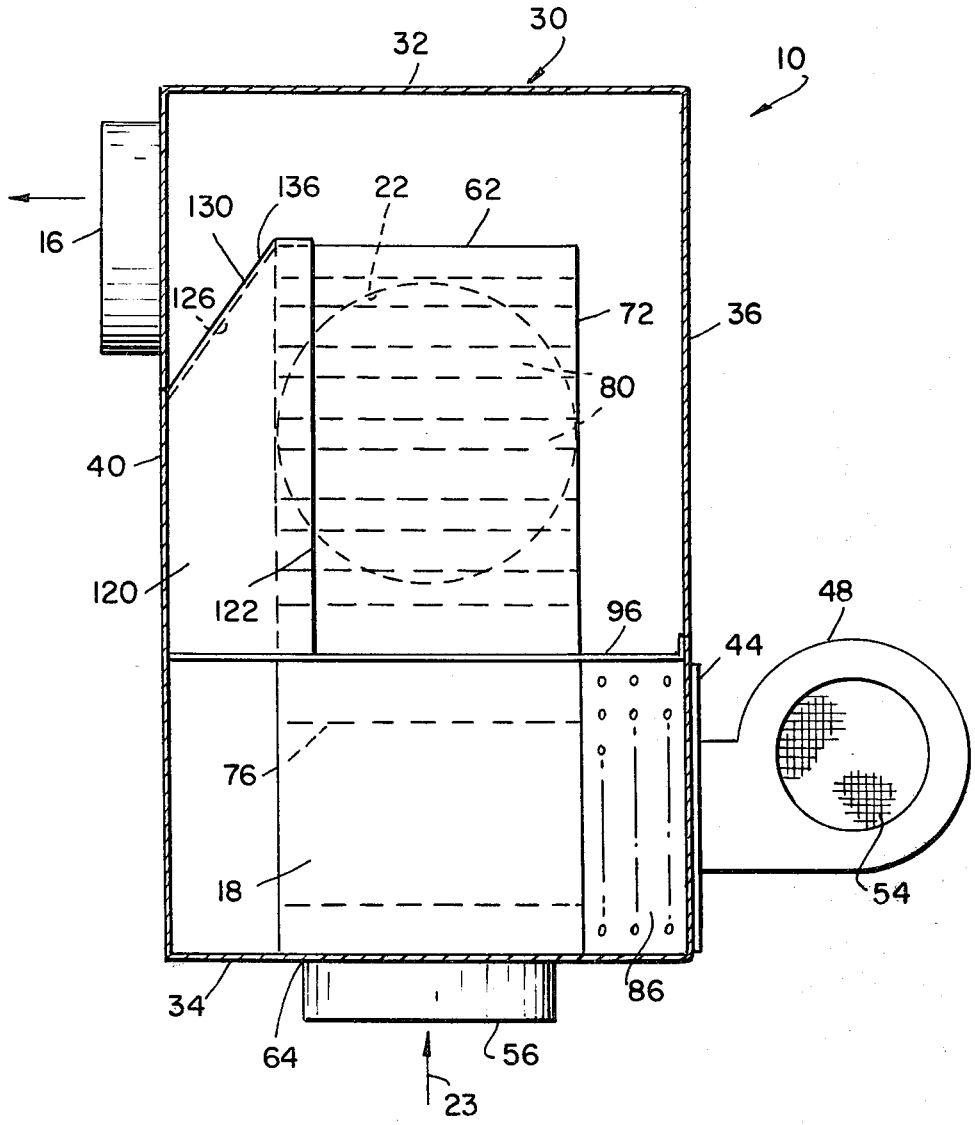
FIG. 6 is a view through 6—6 of FIG. 5.

The bafffle device 28 also includes a vertical plate 120 as best seen in FIGS. 1 and 6 which has a first edge 122 that extends from the horizontal plate 96 to the upper inner end 62 of the inner chamber. A second edge 124 which is shorter than the first edge 122 extends upward from the horizontal plate. A third edge 126 extends between the first and second edges 122 and 124 and is preferably at an angle of approximately 120 degrees to the edge 124. It is within the scope of the present invention to use only any other desired angle between the edges 124 and 126. An important consideration is that the air flow which exits from outlet 16 will not be restricted due to the interference plate 120. A slanted plate 130 as best seen in FIGS. 5 and 6 is fixed along one edge 132 to the upper inner end 62. A second edge 134 is affixed to the side wall 38 while another edge 136 is adjoined to the slanted third edge 126. The fourth edge of the plate 138 is adjoined alone the side wall 40.

The baffle device further includes an extension plate 140 which is best seen in FIG. 5 and is disposed from the slanted plate 130 to the inner wall 66 that is opposite the inlet 14 of the outer chamber. The extension plate 114 has a first edge 142 that is adjoined to the slanted plate 130. A second edge 144 of the plate is affixed to the upper end of the inner chamber. A third edge 146 is joined along the wall 38 while the fourth edge 148 is preferably flush with the inner wall 68.

An on-off switch and junction box 150 may be affixed to the side wall 136. Line 152 leads to a power source such as a conventional wall outlet. An automatic thermostat 134 may also be affixed to the side wall 36 and connected to the junction box 150 by line 156. A heat sensor 158 is located in the flow of air through the outer chamber. In operation, depending upon the temperature of the air in the outer chamber, the thermostat affects the blower to turn it on and off.

To more fully understand the present invetion, a detailed description of its operation follows. A flow of heated gas 23 is directed from a flue stack into the inlet pipe 56. From here the gas flows through the inner chamber 18 where it crosses the heat exchange tubes 24. Then the gas finally passes through the outlet pipe 58 and back into a flue stack and released into the atmosphere.

When the air in the outer chamber has reached a certain desired temperature, the thermostat 154 turns on the blowers 48 and 50 to force a flow of air 17 which may initially be at room temperature through the outer chamber. The air enters the inlet 14 and passes into the outer chamber 12. A portion of the air flow enters the tubes 76 and is heated by the gas 23 passing around the tubes. The perforation plates permit the rest of the first air flow 17, (approximately 50%) to pass through the outer chamber and contact the outer surface of the inner walls 68 and 72. Thus extra heat is also transferred from the flow of heated gas across the inner walls to the flow of air. The two portions of the flow of air 17 are then able to recombine on the side of the outer housing opposite the inlet 14. The air flow 17 then moves upward through the L-shaped opening 116. The baffle including the slanted plate 130, the vertical plate 120 and the extension plate 140 (as best seen in FIGS. 5 and 6) forces the air through the tubes 80 to again transfer heat from the flow 23 which passes through the second section 82 of the inner chamber 18. Further, a portion of the flow of air 17 passes between the side wall 38 and the inner wall 68 as well as across the heated outlet pipe 58. This portion of the air flow can remove heat from pipe 58 as well as the walls of the inner chamber. The flow of air again recombines and passes upward between the side wall 42 and the combined wall formed by inner wall 72 and the vertical plate 120 as seen in FIG. 6. The flow is also forced across the space between the inner inner end 62, the extension plate 140, the slanted platee 130 and the upper outer end 32. The flow of air 17 finally exits the heat exchanger through the outlet 16 and may be delivered to any desired space which is to be heated.

When the temperature of the flow of air 17 becomes too low, the thermostat 154 turns off the blower. Then, when the air again reaches an appropriate level, the cycle begins over.

It can thus be appreciated by one skilled in the art that there has been provided a baffled heat exchanger which is relatively inexpensive to manufacture, and is very efficient in extracting heat from the flue gas which passes therethrough, and relatively easy to install.

While there has been described what is at present considered to be the preferred embodiment of the invention, it will be obvious to those skilled in the art that various changes and mofidications may be made therein without departing from the invention, and it is, therefore, aimed in the appended claims to cover all such changes and modifications as fall within the true spirit and scope of the invention.

I claim:

1. A heat exchanger comprising:

(a) an outer chamber having an inlet and an outlet for passing a flow of air through the outer chamber, (b) an inner chamber disposed within said outer chamber having a second inlet and second outlet for passing a flow of gas through said inner chamber, (c) heat exchange tubes being arranged in said inner chamber whereby said flow of gas contacts the outer surface of said tubes, and wherein said heat exchange tubes include a first plurality of tubes disposed in a first section of said inner chamber closest to said second inlet, and a second plurality of tubes disposed in a second section of said inner chamber above said first section so that air passes through the heat exchange tubes in the first and second sections for higher heat exchange;

(d) baffle means disposed between said inner and outer chambers for directing said flow of air from said inlet through said heat exchange tubes wherein said baffle means includes a horizontal plate joined between the inner and outer chambers at the juncture of the first and second sections and extending partially around the inner chamber to form an L-shaped opening whereby the flow of air enters the first plurality of tubes, then into said outer chamber and back into said heat exchange tubes whereby heat is exchanged between the air and gas flows.

2. The heat exchanger of claim 1 wherein said outer chamber has spaced, opposed upper and lower outer ends and four side walls adjoining said outer ends, and further wherein said inlet is in a first side wall adjacent said upper end in a second side wall opposing said first side wall.

3. The heat exchanger of claim 2 wherein said inner chamber has a continuous wall disposed within said outer chamber and spaced, opposed upper and lower inner ends adjoined to said continuous wall and opposite said upper and lower outer ends respectively, said upper inner end is spaced from said upper outer end, said inner chamber is provided with said second inlet in said lower inner end and said second outlet is disposed in the wall of said inner chamber.

4. The heat exchanger of claim 3 wherein said second inlet includes an inlet pipe which extends through said lower outer end and said second outlet is connected to an outlet pipe which extends through a third side wall.

5. The heat exchanger of claim 4 wherein the continuous wall of said inner chamber includes four inner walls and said heat exchange tubes are connected between opposing inner walls which are disposed opposite the inlet and outlet of said outer chamber.

6. The heat exchanger of claim 5 wherein said baffle means further includes two vertical perforation plates between the edges of the inner wall and the first side wall and from the horizontal plate to said lower outer end, for operating in conjunction with said horizontal plate to permit a portion of the flow of air to bypass the first plurality of tubes and pass through the outer chamber.

7. The heat exchanger of claim 6 wherein said baffle means further includes a vertical plate having a first edge which extends from the horizontal plate to the upper inner end of the inner chamber and having a second edge shorter than said first edge and extending upward from the horizontal plate, said vertical plate is adjoined along the second edge to the second side wall, so that a slanted third edge extends towards the upper inner end, a slanted plate is fixed to the upper inner end, the second side wall, the slanted third edge and the third side wall whereby the air flow which has passed through and around the first section of the inner chamber is directed by the combination of the vertical and slanted plates into the second plurality of tubes.

8. The heat exchanger of claim 7 wherein said baffle means also includes an extension plate disposed from said slanted plate to said inner wall which is opposite the inlet of said outer chamber whereby the combination of the extension plate and the horizontal plate creates an open flow area to direct a portion of said flow of air between said first and second chambers and across said outlet pipe, after which it recombines with the flow of air exiting from the second plurality of tubes.

9. The heat exchanger of claim 8 wherein said outer chamber has a closure element secured to the outer end for directing the flow of air across the inner chamber and out of the outlet.

* * * * *